United States Patent [19]

Goldman et al.

[11] Patent Number: 4,748,301

[45] Date of Patent: May 31, 1988

[54] ELECTRIC CIRCUIT BREAKER ARC CHUTE COMPOSITION

[75] Inventors: Ira B. Goldman, Waterbury; Karen B. Lausier, Plymouth, both of Conn.

[73] Assignee: General Electric Company, New York, N.Y.

[21] Appl. No.: 56,187

[22] Filed: Jun. 1, 1987

[51] Int. Cl.[4] ..... H01H 33/02

[52] U.S. Cl. ..... 200/144 C; 200/149 A

[58] Field of Search ..... 200/144 C, 149 A, 149 R

[56] References Cited

U.S. PATENT DOCUMENTS

| | | | |
|---|---|---|---|
| 2,005,684 | 6/1935 | Sachs | 200/144 R |
| 2,439,929 | 4/1948 | Hill et al. | 200/148 C |
| 2,551,822 | 5/1951 | Bingenheimer et al. | 200/144 R |
| 3,761,660 | 9/1973 | Jones | 200/144 C |
| 3,786,213 | 1/1974 | Holmstrom | 200/149 A |
| 4,278,859 | 7/1981 | Borona | 200/144 C |
| 4,375,021 | 2/1983 | Pardini et al. | 200/147 R |

OTHER PUBLICATIONS

Patent application Ser. No. (Docket 41PR-6577), "Electric Circuit Breaker Arc Chute Composition", Franco P. Pardini, filed concurrently.

*Primary Examiner*—Robert S. Macon

*Attorney, Agent, or Firm*—Richard A. Menelly; Walter C. Bernkopf; Fred Jacob

[57] ABSTRACT

A current limiting circuit breaker having a pair of separable contacts closely spaced for electrodynamic repulsion upon the occurrence of a short circuit overload condition utilizes an arc chute to cool and extinguish the arc that occurs when the contacts become separated. The arc chute contains a plurality of metal arc plates supported by side plates which also assist in cooling and extinguishing the arc. The side plates are formed from a three-layer configuration wherein the two outer layers have excellent arc extinguishing properties while the inner layer has good mechanical support strength.

20 Claims, 3 Drawing Sheets

ELECTRIC CIRCUIT BREAKER ARC CHUTE COMPOSITION

BACKGROUND OF THE INVENTION

U.S. Pat. No. 4,375,021, in the name of Franco T. Pardini and Francesco DeVizzi, describes the use of a magnetic assembly arranged about the circuit breaker contacts for electrodynamically repulsing the contacts and for electrodynamic motivation of the arcs that occur when the contacts become separated. The arc chute used within the breaker for cooling and extinguishing the arc is formed by enfolding a metal strip partially around an insulating support substrate.

U.S. Pat. Nos. 2,005,684 and 2,551,822 both teach arc chute assemblies that contain a composite structure of one material having good arc resistant properties such as asbestos alongside another material having good physical support properties.

When the Pardini et al. circuit breaker is used to interrupt short circuit current at rated voltages in excess of 400 volts, it has been determined that the arc chute side supports interfere with the arc extinguishing process at the higher arc temperatures and higher arc voltages. Asbestos materials, having excellent high temperature and electrical resistance properties, are no longer available to the electrical industry by legislative mandate.

U.S. patent application (41PR-7577) entitled "Electric Circuit Breaker Arc Chute Composition" describes a two-layer laminate structure for arc plate side supports wherein the layer facing the arc consists of a resin impregnated cloth fiber while the opposite layer consists of a resin-impregnated glass fiber. The opposite layers must be color-coded to insure that the cloth fibers face the arc rather than the glass fibers. Should the glass fibers become subjected to the temperatures generated within the arc chute, the low ionization potential elements within the glass fibers would become ionized and thereby interfere with the arc extinction process.

One purpose of the instant invention accordingly is to provide arc chute side support materials having the necessary thermal and electrical resistant properties while maintaining sufficient physical strength to survive the arc heating effects generated within higher voltage circuits without color-code or other orientation requirements.

SUMMARY OF THE INVENTION

Current limiting electric circuit breakers rated in excess of 400 volts utilize a three-layer arc chute side support structure for deionizing and cooling electric arcs. The inner layer consists of a thermoset resin having a woven glass fabric encapsulated therein. The two outer layers consist of a similar thermoset resin having a linen cloth woven fabric encapsulated therein. The three layer arc chute side support configuration insures that the arc resistance cloth-resin composition faces the arc.

DESCRIPTION OF THE PREFERRED EMBODIMENT

Figure 1:
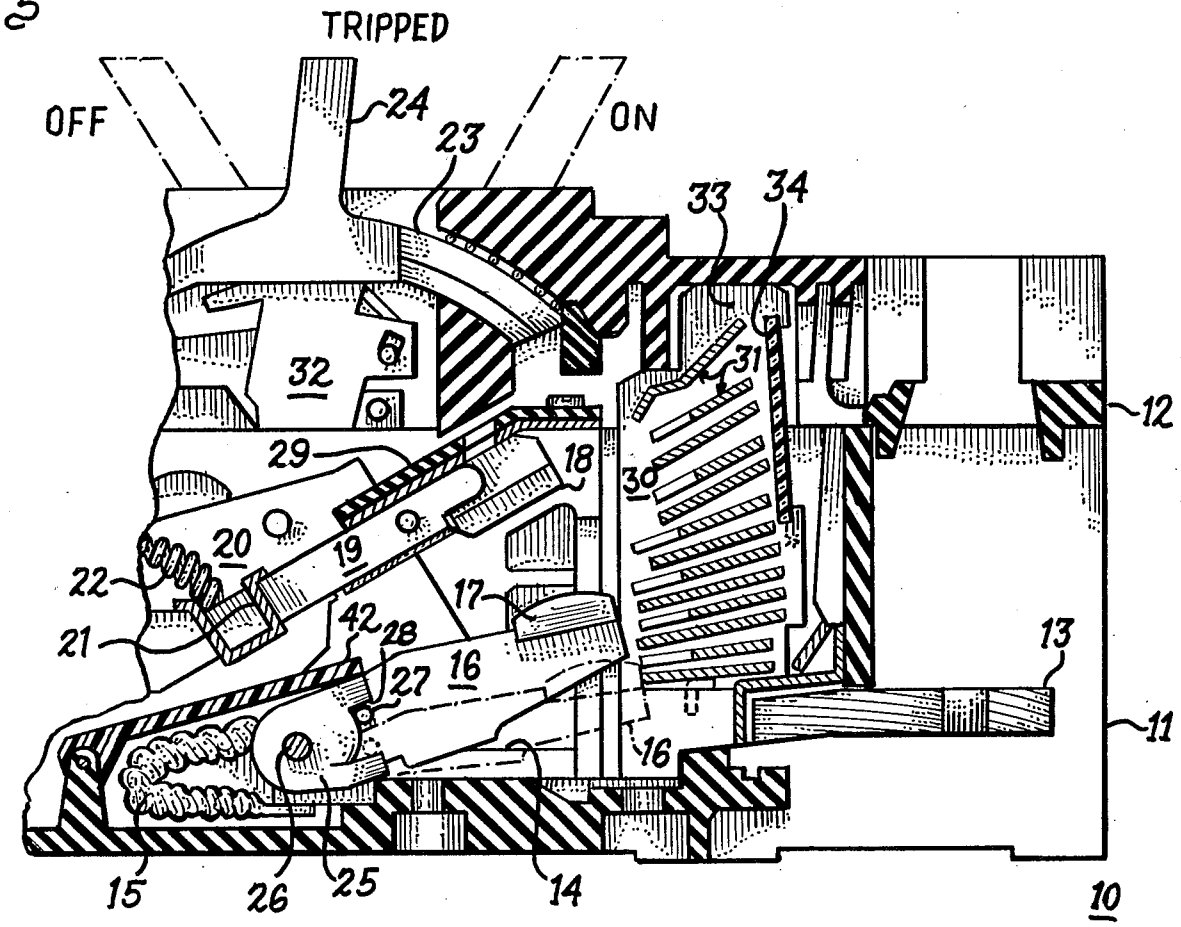
FIG. 1 is a side view of a current limiting circuit breaker containing the arc chute of the invention depicted in partial section.

A molded case circuit breaker 10, similar to that described within the aforementioned patent to Pardini et al, is shown in FIG. 1 to consist of an insulative case 11 and an insulative plastic cover 12. A line terminal 13 connects with a bottom contact carrier 16 by means of a line strap 14 and a copper braid conductor 15. A bottom contact 17 is welded or brazed to the bottom contact carrier for cooperating with an upper contact 18 welded or brazed to an upper contact carrier 19, as indicated. The upper contact carrier 19 is operated by means of an operating mechanism generally depicted at 20 and is biased in a counterclockwise direction by means of a contact spring 22 to insure good electrical connection between the upper and lower contacts 18, 17, when the operating handle 24 is moved to its "ON" position. The operating handle cooperates with the operating mechanism 20 and crossbar 21 by means of the handle skirt 23 and the mechanism side frame 32, one of which is removed to clearly show the lower contact carrier support 25 and pivot 26. The lower contact carrier pivots independent from the tripped position shown in FIG. 1, wherein the pin 27 attached to the lower contact arm carrier 16 is at its uppermost position within the slot 28 formed within the support 25. When the operating handle is "on" and contacts are in the "closed" position, the pin 27 is then at its bottommost position within the slot. In order for the upper and lower contact carriers 19, 16 to be closely spaced together for maximum electrodynamic repulsion upon short circuit conditions through the contacts, an insulating plate 42 is arranged between the contact carriers to prevent inadvertent conduction between the carriers. An upper insulated plate 29 is positioned above the upper contact carrier 19 to act as a stop for the upper contact carrier when driven to its tripped position as shown and to assist in motivating the arc away from the contacts into the arc chute 30 which is positioned intermediate the contacts and the line terminal 13.

The arc chute 30 contains a plurality of spaced metallic arc plates 31 supported by a pair of side supports 33, one of which is removed to show the location of the arc plates with respect to the back support 34. The arc plate side supports 33 and the back support 34 are formed from a high temperature-resistant insulative fiber material.

Figure 2:
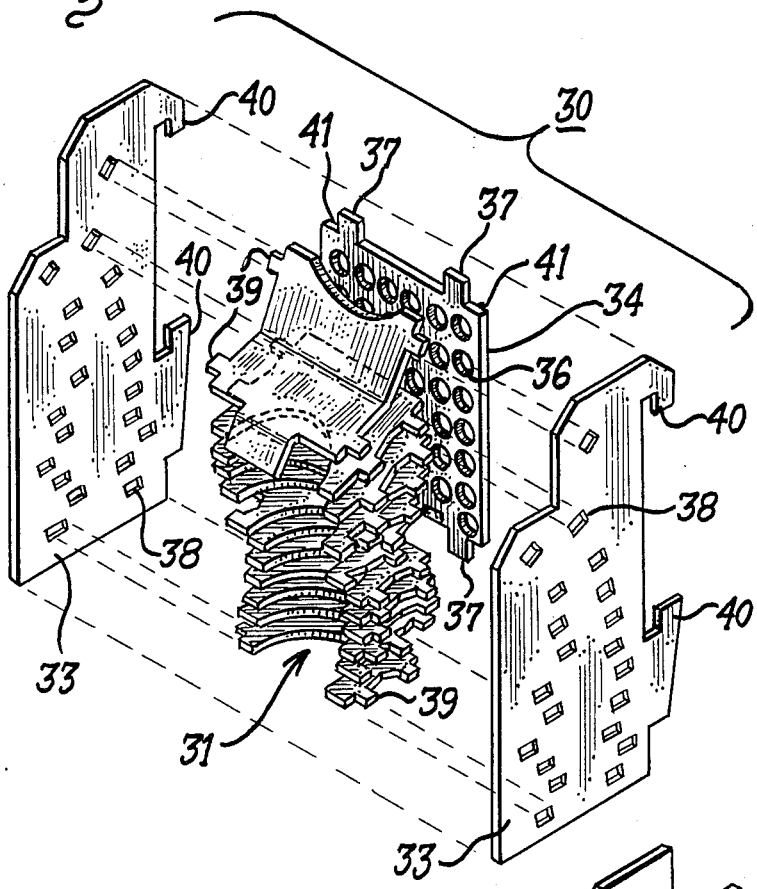
FIG. 2 is an enlarged front perspective view of the arc chute of FIG. 1 with the sides and back sections in isometric projection from the arc plate.

The configuration of the arc chute is best seen by referring to FIG. 2 wherein the arc chute side supports 33 contain a plurality of slots 38 punched or formed therein for receiving a corresponding plurality of tabs 39 formed within the metallic arc plates 31. The side supports are attached to the back support 34 by arranging the hooked projections 40 on the side supports over the edges 41 formed on the top surface of the back support next to or outboard the pair of upstanding tabs 37 on the top surface of the back support. In operation, the arc is electrodynamically driven within the arc plates 31 wherein it is cooled and quenched as rapidly as possible. To assist in the arc quenching process, the side supports 33 include a gas evolving resin material which becomes heated and evolves a substantial quantity of disassociated gaseous material, which immediately becomes expelled from the arc chute through a series of holes 36 arranged within the back support.

Figure 3:
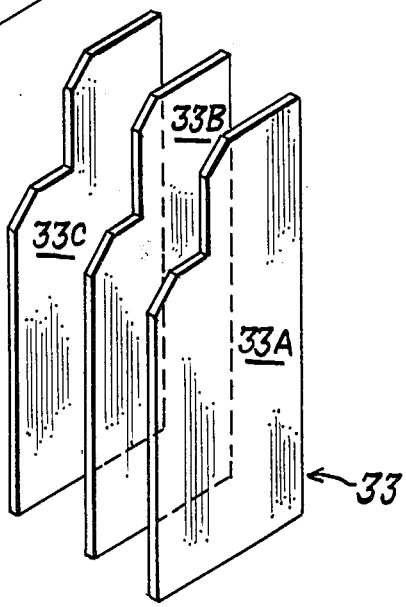
FIG. 3 is a top perspective view, in isometric projection, of the three laminate layers used to form the side supports depicted in FIG. 2.
Figure 4:
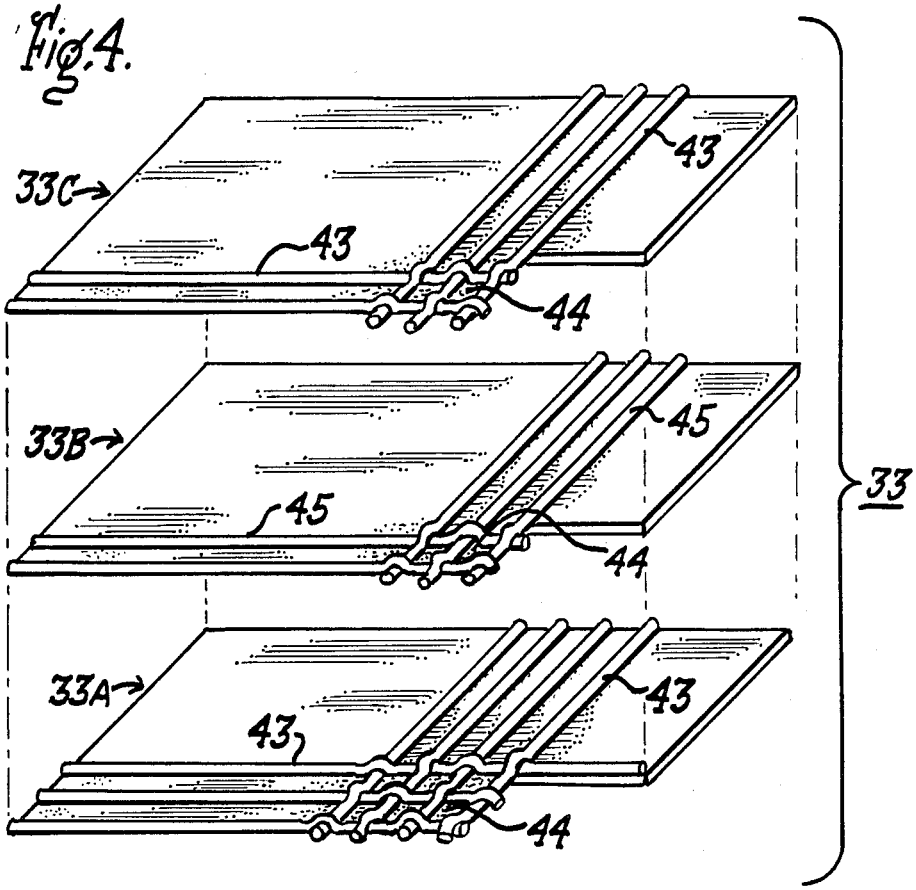
FIG. 4 is an enlarged top perspective view of the laminate layers used to form the side supports shown in FIG. 3 prior to lamination.

To insure that the arc chute side supports 33 are capable of sustaining both the high voltage gradiant developed across the arc plates and the high temperatures associated with the arc, the side plates have the configuration depicted in FIGS. 3 and 4 prior to lamination. The three separate layers 33A–33C are ultimately laminated together under heat and pressure for good mechanical support. For high dielectric strength, and arc tracking resistance, the outer layers 33A, 33C comprise a plurality of woven cloth fibers 43 made from linen cloth which are subsequently impregnated with a melamine resin 44. The resin is made by condensing formaldehyde with melamine, wherein the melamine comprising the general formula $C_3H_6N_6$. The melamine resin thereby combining in such a manner as to readily disassociate such gaseous materials upon reaching elevated temperatures. The inner layer 33B comprises a plurality of woven glass fibers 45 within which melamine resin 44 is impregnated in a similar manner as for the outer layers 33A, 33C. The glass fibers are selected for sustaining good mechanical support strength at the high temperatures to which the side supports 33 are subjected during arcing. It was earlier determined, for arc voltages in access of 400 volts for example, that the glass fibers 45 evolve low ionization potential materials when directly exposed to the electric arc. The electrical resistance properties of the cloth fibers 43 are such that the side supports remain non-conductive during the arcing process even when exposed to the electric arc. The use of resin-impregnated cloth fibers without the inner layer of glass fibers were earlier found to be incapable of providing the physical support required at the higher arc temperatures and summarily became deformed.

Figure 5A:
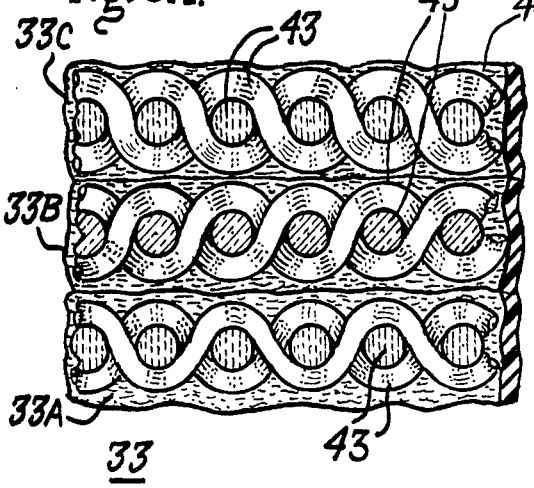
FIG. 5A is an enlarged side sectional view of the side support 33 depicted in FIG. 4 after lamination.

The layers 33A–33C are laminated together by impregnating the three separate layers and by heating and compressing the layers to cause interlaminar flow of the melamine resin as best seen by referring now to FIG. 5A. The woven glass fibers 45 and the woven cloth fibers 43 are shown completely encapsulated within the melamine resin 44.

Figure 5B:
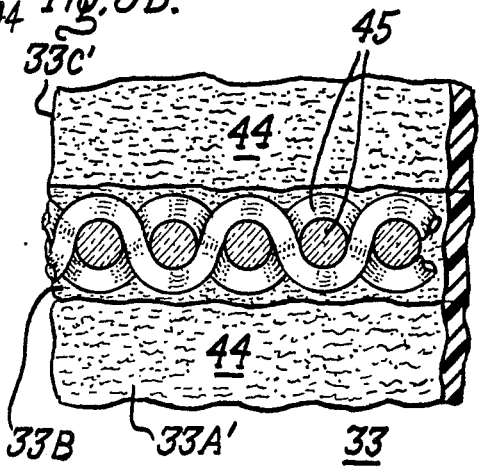
FIG. 5B is an enlarged side sectional view of an alternate embodiment of the side support shown in FIG. 5A.

In some applications, where the interruption current is held within predetermined levels, the configuration shown in FIG. 5B can be employed. Here the side support 33 is formed from a central support layer 33B comprising woven glass fibers 45 impregnated with the melamine resin 44 and the outer layers 33A', 33C' solely comprise a thick layer of melamine resin 44. The melamine resin has sufficient dielectric properties to withstand the higher arc voltages and is prevented from physically deforming by means of the inner layer of glass fibers.

It has thus been shown that good arc extinction is provided to current limiting circuit breakers in excess of 400 arc volts by a three layer arrangement of outer layers having good dielectric resistance supported by an inner layer having good mechanical strength.

Having described our invention what we claim as new and desire to secure by Letters Patent is:

1. A molded case circuit breaker comprising:

a molded plastic case and cover;

a pair of separable contacts within said case;

an operating mechanism moving said contacts between open and closed positions; and an arc chute facing said contacts and extinguishing an arc which occurs when said contacts become separated during overcurrent conditions, said arc chute including a plurality of spaced metal plates supported between a pair of side supports and an apertured back support, said side supports each comprising an arrangement of a layer of resin-impregnated glass fibers sandwiched between a pair of outer layers of resin-impregnated cloth fibers.

2. The circuit breaker of claim 1 wherein said resin comprises melamine resin.

3. The circuit breaker of claim 1 wherein said cloth fibers comprise linen.

4. The circuit breaker of claim 1 wherein said glass fibers are interwoven.

5. The circuit breaker of claim 1 wherein said cloth fibers are interwoven.

6. The circuit breaker of claim 1 wherein said layer of glass fibers is laminated to said outer layers of cloth fibers by heat and pressure.

7. The circuit breaker of claim 1 wherein said melamine resin comprises the combination of melamine with formaldehyde.

8. The circuit breaker of claim 1 wherein said melamine has the composition $C_3H_6N_6$.

9. A molded case circuit breaker comprising:

a molded plastic case and cover;

a pair of separable contacts within said case;

an operating mechanism moving said contacts between open and closed positions; and an arc chute facing said contacts and extinguishing an arc which occurs when said contacts become separated during overcurrent conditions, said arc chute including a plurality of spaced metal plates supported between a pair of side supports and an apertured back support, said side supports each comprising an arrangement of a layer of resin-impregnated glass fibers sandwiched between a pair of outer layers comprising melamine resin.

10. The circuit breaker of claim 9 wherein said glass fibers are interwoven.

11. The circuit breaker of claim 9 wherein said melamine resin comprises the combination of melamine with formaldehyde.

12. The circuit breaker of claim 9 wherein said melamine has the composition $C_3H_6N_6$.

13. The circuit breaker of claim 9 wherein said layer of glass fibers is laminated to said outer layers of melamine resin by heat and pressure.

14. An arc chute comprising:

a pair of opposing apertured side supports and a perforated back support; and a plurality of metal plates having tabs extending from opposing edges, said tabs being located within corresponding apertures formed within said side supports;

said side supports having hooked extensions formed within a top surface and arranged over edges formed within a top surface of said back support;

said side supports each comprising at least one inner layer of glass fibers impregnated with a polymer resin sandwiched between a pair of outer layers of cloth fibers impregnated with said polymer resin.

15. The arc chute of claim 14 wherein said resin comprises melamine resin.

16. The arc chute of claim 14 wherein said glass fibers are interwoven.

17. The arc chute of claim 14 wherein said cloth fibers are interwoven.

18. The arc chute of claim 14 wherein said cloth fibers comprise linen.

19. The arc chute of claim 15 wherein said melamine resin comprises the combination of melamine with formaldehyde.

20. The arc chute of claim 14 wherein said melamine has the composition $C_3H_6N_6$.

* * * * *